US006095225A

United States Patent [19]

Miller

[11] Patent Number: 6,095,225

[45] **Date of Patent: *Aug. 1, 2000**

[54] SHUTTER SLAT WITH INTEGRATED SCREW BOSS

[76] Inventor: James V. Miller, 893 N. Maryknoll Cir., Glen Ellyn, Ill. 60137

[ * ] Notice: Under 35 U.S.C. 154(b), the term of this patent shall be extended for 00 days.

[21] Appl. No.: 09/276,078

[22] Filed: Mar. 25, 1999

Related U.S. Application Data

[63] Continuation-in-part of application No. 09/135,984, Aug. 17, 1998, abandoned.

[51] Int. Cl.[7] ..... E06B 9/08

[52] U.S. Cl. ..... 160/133; 160/273.1

[58] Field of Search ..... 160/133, 264, 160/236, 232, 235, 273.1, 206

[56] References Cited

U.S. PATENT DOCUMENTS

| | | | |
|---|---|---|---|
| 845,526 | 2/1907 | Collins . | |
| 1,014,315 | 1/1912 | McCloud . | |
| 1,352,656 | 9/1920 | Cahill . | |
| 1,776,119 | 9/1930 | Johnson . | |
| 1,892,570 | 12/1932 | Ginder . | |
| 1,918,415 | 7/1933 | Miller . | |
| 2,350,287 | 5/1944 | Michelman | 160/133 |
| 2,545,400 | 3/1951 | White | 160/133 |
| 2,812,813 | 11/1957 | Zarnowski | 160/133 |
| 2,858,883 | 11/1958 | Rapin | 160/235 |
| 3,292,685 | 12/1966 | Clark | 160/26 |
| 3,489,200 | 1/1970 | Recchione | 160/133 |
| 3,670,797 | 6/1972 | Sassano | 160/118 |
| 4,037,639 | 7/1977 | Jones | 160/133 |
| 4,294,302 | 10/1981 | Ricke, Sr. | 160/133 |
| 4,332,287 | 6/1982 | Stolpe | 160/133 |
| 4,343,340 | 8/1982 | Paule | 160/232 |
| 4,345,635 | 8/1982 | Solomon | 160/133 |
| 4,379,479 | 4/1983 | Whiting | 160/201 |
| 4,386,645 | 6/1983 | Dever et al. | 160/183 |
| 4,519,434 | 5/1985 | Forquer | 160/133 |
| 4,611,848 | 9/1986 | Romano | 296/98 |
| 4,628,982 | 12/1986 | Labelle | 160/235 |

(List continued on next page.)

FOREIGN PATENT DOCUMENTS

WO 87/03641 6/1987 WIPO .

OTHER PUBLICATIONS

Croci, "AR/77 Profile," 1998 catalogue update sheets, eight diagrams and descriptions, 2 pages.

SIRO, Safety Roller Blinds, "Safety roller blind Type Sd," "Safety roller blind Type Se 2 mm and Type Se 3 mm," "Safety roller blinds," 4 pages.

Sweet's General Building & Renovation 1997 Catalog File, Windsor Door, "Metal Rolling Doors & Operators," 08330/WIN, BuyLine 7014, pp. 1–16.

(List continued on next page.)

*Primary Examiner*—David M. Purol

*Attorney, Agent, or Firm*—Marshall, O'Toole, Gerstein, Murray & Borun

[57] ABSTRACT

The present invention is directed to a rolling protective shutter having slats with integrated screw bosses formed in their hinges. Each slat includes a first elongated socket along one edge of the slat, and a second elongated socket along the opposite edge of the slat. The hinges of the shutter curtain are formed by pivotally disposing the second elongated socket of one slat within the first elongated socket of an adjacent slat. After the shutter curtain is assembled, alignment/retention members are attached to either end of the second elongated socket to keep the slats substantially vertically aligned and retained within the side tracks. The alignment/retention members engage the adjoining slats to prevent substantial relative movement of the interconnected slats, and are dimensioned so that the alignment/retention members do not extend beyond the surfaces of the slats. Consequently, the shutter curtain may be tightly rolled onto the shutter support member without interference from the alignment/retention members.

13 Claims, 6 Drawing Sheets

U.S. PATENT DOCUMENTS

| | | | |
|---|---|---|---|
| 4,723,588 | 2/1988 | Rüppel | 160/236 |
| 4,738,296 | 4/1988 | Hatch | 160/133 |
| 4,929,862 | 5/1990 | Hamilton et al. | 312/138.1 |
| 5,154,468 | 10/1992 | Teigen et al. | 296/24.1 |
| 5,165,746 | 11/1992 | Teigen | 296/24.1 |
| 5,204,147 | 4/1993 | Schneider | 428/35.8 |
| 5,253,694 | 10/1993 | Bernardo | 160/133 |
| 5,343,924 | 9/1994 | Hoffman | 160/235 |
| 5,365,990 | 11/1994 | Ueda | 160/23.1 |
| 5,372,175 | 12/1994 | Calhoun et al. | 160/235 |
| 5,377,738 | 1/1995 | Cooper | 160/133 |
| 5,469,905 | 11/1995 | McKinney et al. | 160/35 |
| 5,482,104 | 1/1996 | Lichy | 160/273.1 |
| 5,575,322 | 11/1996 | Miller | 160/133 |
| 5,601,130 | 2/1997 | Werner et al. | 160/183 |
| 5,657,805 | 8/1997 | Magro | 160/133 |
| 5,682,937 | 11/1997 | Decrane et al. | 160/133 |
| 5,839,493 | 11/1998 | Quasius | 160/133 |

OTHER PUBLICATIONS

Sweet's General Building & Renovation 1997 Catalog File, Raynor, "Rolling Doors & Electric Operators," 08330/RAY, BuyLine 3491, pp. 1–36.

Sweet's General Building & Renovation 1997 Catalog File, R & S, "Rolling Door Products," 08330/RSM, BuyLine 7130, pp. 1–14.

Sweet's General Building & Renovation 1997 Catalog File, McKeon, JG Wilson, "Rolling Doors—Grilles—Fire Doors," 08330/MCK, BuyLine 6566, pp. 1–16.

Sweet's General Building & Renovation 1996 Catalog File, Hurst Awning Company, Inc., "Accordion Shutters/Removable Shutters," B492, 08667/HUR, BuyLine 6400, pp. 1–8.

Croci, "Security Rolling Shutter Profiles," *Rollita* 1996 General Catalogue, 24 pages.

SHUTTER SLAT WITH INTEGRATED SCREW BOSS

CROSS-REFERENCE TO RELATED APPLICATION

This application is a continuation-in-part of U.S. application Serial No. 09/135,984, filed Aug. 17, 1998 now abandoned.

BACKGROUND OF THE INVENTION

The present invention is directed to a rolling protective shutter assemblies and, in particular, to an improved single-wall shutter slat with an integrated screw boss.

Rolling protective shutters are conventional and are used to provide protection against extreme weather conditions and to deter theft, for example. One such rolling protective shutter is disclosed in U.S. Pat. No. 4,345,635 to Solomon. As shown in FIGS. 1 and 2 of that patent, the Solomon shutter is composed of a plurality of elongated single-wall slats, each of which has a pair of circular ribs attached to its sides. The slats are interconnected by a plurality of elongate hinges, each of which has a pair of circular apertures in which the circular ribs of the slats are disposed. When the Solomon shutter is unrolled to its protective position, each of the slats in the shutter is disposed vertically with the ends of the slats disposed with guide channels or side tracks on either side of the opening. When not in use, the Solomon shutter may be rolled up into a housing disposed at the upper end of the protective shutter.

Another type of rolling protective shutter is disclosed in U.S. Pat. No. 5,365,990 to Ueda. As shown in FIGS. 2 and 3 of that patent, the Ueda shutter is composed of a plurality of double-wall slats, each of which has an upper rearward hook extending longitudinally along the upper edge of the slat and a lower U-shaped recess extending longitudinally along the lower edge of the slat. The recess has a forward horizontal projection on a rear edge and extending longitudinally so that when the lower slat moves down under gravity, the hook of the lower slat bears on the horizontal projection of the upper slat. The Ueda shutter may be rolled up and unrolled in a similar manner as the Solomon shutter.

In rolling shutter systems such as the Solomon and Ueda shutters, the slats of the shutter must be held in vertical alignment so that the shutter is properly deployed into and retracted from the side tracks without binding. In shutters formed by double-wall slats, such as the Ueda shutters, the slats are held in alignment by side plugs, such as the slide members in FIGS. 4 and 5 of the Ueda patent. An insert portion of a slide member is inserted into the hollow end portion of the slat, and the upper and lower blades of the slide member engage the ends of the adjoining slats. The slide members are inserted on both sides of the shutter to retain the slats in vertical alignment. Alternatively, some previous double-wall slats include screw bosses integrally formed within the hollow portions of the slats, with the side plugs being attached to the slats with screws or other fasteners that are inserted into the screw bosses. Due to the thickness of the double-wall slats, the side plugs can align the slats while fitting within the thickness of the slats and, therefore, do not increase the roll diameter of the shutter.

Conversely, single-wall slats, such as those in the Solomon patent, do not provide a hollow portion into which a side plug may be inserted or within which a screw boss can be integrally formed. Another example of a previously known single-wall slat is shown in FIG. 1. The slat 2 has a slat portion 4 with an elongated socket 6 integrally formed along one longitudinal edge 7 of the slat portion 4, and a rod 8 integrally formed along the other longitudinal edge 9 of the slat portion 4. To form a shutter curtain, a plurality of slats 2 are connected by inserting the rod 8 of one slat 2 into the socket 6 of the adjoining slat 2. This single-wall slat configuration permits the shutter curtain to be tightly wound around the shutter roll. As can be seen, the single-wall slat 2 does not provide a point of attachment for hardware that vertically aligns the interconnected slats 2.

One alternative for attaching alignment hardware involves integrally forming a screw boss on one of the surfaces of the slat portion 4 proximate either the socket 6 or the rod 8. After the shutter curtain is assembled, a screw and washer are attached to the slat 2 to engage the connected socket 6 and rod 8 to align the adjoining slats 2. This alternative aligns the slats 2, but the slat portion 4 is relatively thin and the screw head and/or the washer extend beyond the sides of the slat 2. The overhanging heads and/or washers may engage the shutter roll and the other attachment hardware such that the shutter curtain cannot be rolled up as tightly and, consequently, may require a larger shutter housing to enclose the rolled-up shutter curtain. Additionally, an external screw boss increases the amount of material used to form the slat and increases the cost of the slat.

Another alternative for attaching alignment hardware is shown in FIG. 2 and includes an additional assembly step of removing portions of the rods 8 at either end of the slats 2 to allow screws to be inserted into the ends of the sockets 6. After the slats 2 are cut to the proper length, a notch is cut in the slat portion 4 along the longitudinal edge 9 inwardly from the end proximate the point where the rod 8 is connected to the slat portion 6. The rod 8 is then cut to remove the end of the rod 8. After the slats 2 are assembled, screws are inserted into the ends of the sockets 6 without interference from the rods 8 and hold the slats 2 in vertical alignment. Screws are omitted from FIG. 2 for the sake of clarity. The shutter curtain may be assembled with screw heads that do not extend past the edges of the sockets 6 such that the curtain may be tightly wound on the shutter roll. However, the additional machining operations required to remove the ends of the rods 8 increase the cost of assembling each shutter curtain and increase the time required to assembly each shutter curtain, thereby reducing the throughput of the assembly facility.

Therefore, a need exists for an improved single-wall slat with an integrated screw boss that facilitates attachment of alignment hardware to the assembled shutter curtain without increasing the amount of space required to store the rolled shutter curtain and without increasing the cost of fabricating the slats and the of assembling the shutter curtain.

In double-wall slats, the open cavity of the slats provides an area for attaching alignment and retention hardware. For example, a screw boss can be formed within the cavity of the slat without affecting how tightly the shutter curtain is rolled. Another arrangement is shown in U.S. Pat. No. 5,253,694, issued to Bernardo. The Bernardo patent discloses an end retainer having a stem that is inserted into the cavity of a double-wall slat. The stem is secured to the slat with several rivets that penetrate an outer wall of the slat. The end retainer extends upwardly and downwardly beyond the cavity to engage and align the adjoining slats. The end retainer also has an outer flange that retains the ends of the slat within the side tracks of the rolling shutter.

To avoid increasing the storage space required for the rolled-up shutter curtain, the end retainers are shaped to match the contour of the slat so that the end retainer does not extend outwardly beyond the front and back walls of the slat. Consequently, a uniquely shaped end retainer is necessary to match the contour of a particular slat profile. Therefore, a need exists for a combination slat alignment and retention system that can be used with single- and double-wall slats of varying contours without increasing the storage space for the rolled up shutter curtain.

SUMMARY OF THE INVENTION

The present invention is directed to a rolling protective shutter having slats with integrated screw bosses formed in their hinges. Each slat includes a first elongated socket along one edge of the slat, and a second elongated socket along the opposite edge of the slat. The hinges of the shutter curtain are formed by pivotally disposing the second elongated socket of one slat within the first elongated socket of an adjacent slat. After the shutter curtain is assembled, alignment/retention members are attached to either end of the second elongated socket to keep the slats substantially vertically aligned and retained within the side tracks. The alignment/retention members engage the adjoining slats to prevent substantial relative movement of the interconnected slats, and are dimensioned so that the alignment/retention members do not extend beyond the surfaces of the slats. Consequently, the shutter curtain may be tightly rolled onto the shutter support member without interference from the alignment/retention members.

According to one aspect, the present invention includes a slat for use in a shutter curtain of a rolling shutter assembly, with a plurality of the slats being interconnected to form the shutter curtain. Each of the slats is connected to at least one adjoining slat, and the slats are maintained substantially vertically aligned by alignment hardware that engages each pair of adjoining slats to prevent substantial relative lateral movement of the slats.

According to another aspect of the present invention, a rolling shutter assembly includes a shutter support member, a shutter coupled to the shutter support member, and a pair of shutter tracks. The shutter is formed from a plurality of individual slats and a plurality of hinges interconnecting the slats. The shutter and shutter support member are adapted to roll the shutter from an unrolled position with the slats disposed in the shutter tracks and a rolled position with the shutter rolled up on the shutter support member.

Each of the slats includes a slat portion, a first socket integrally formed along a first longitudinal edge of the slat portion, and a second socket integrally formed along a second longitudinal edge of the slat portion. The hinges of the shutter are formed by inserting the second socket of one slat into the first socket of an adjoining slat. The first socket of one slat is adapted to engage the second socket of the adjoining slat to facilitate rotation of the slats between a first position and a second position. In the first position, the first and the second sockets of one slat are substantially linearly aligned with the first and second sockets of the joining slat. In the second position, the slat portions of the adjoining slats form an arc having a substantially constant radius of curvature.

The features and advantages of the invention will be apparent to those of ordinary skill in the art in view of the detailed description of the preferred embodiments, which is made with reference to the drawings, a brief description of which is provided below.

DETAILED DESCRIPTION OF THE PREFERRED EMBODIMENTS

Figure 3:
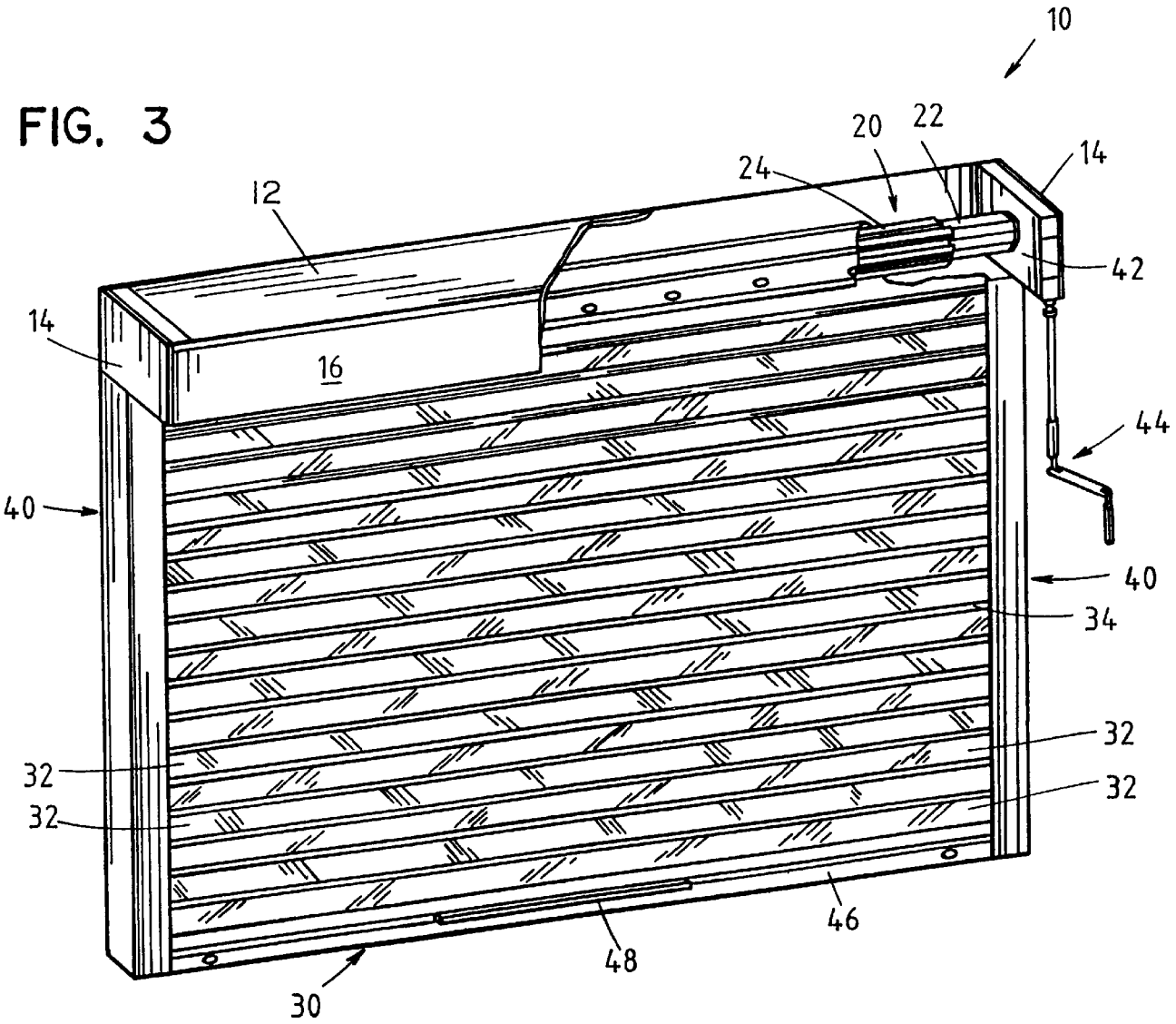
FIG. 3 is a perspective view of a rolling shutter assembly that can implement the present invention.

One type of a rolling shutter assembly 10 that may implement the present invention is shown in FIG. 3. The shutter assembly 10 has a shutter housing which includes a top wall 12, a pair of side walls 14, and a front wall 16. A shutter support member 20 is mounted for rotation within the shutter housing. The support member 20 includes a generally cylindrical central shaft 22 and a plurality of mounting members 24 fixed to the shaft 22.

The upper end of a rolling shutter 30 is coupled to the mounting members 24. The shutter 30 is composed of a plurality of individual, elongate slats 32. The ends of the slats 32 are disposed within a pair of shutter tracks 40.

The shutter assembly 10 has a gearbox 42 which interconnects the rotatable shaft 22 with a hand crank 44 via a conventional gear assembly (not shown). When mounted to protect a window or other opening, the shutter tracks 40 of the shutter assembly 10 are positioned on either side of the opening and the shutter housing is positioned over the top of the opening. Alternatively, in some applications, the side tracks 40 and shutter housing are positioned within the opening. When the shutter 30 is not in use, it is rolled up on the shutter support member 20 via the hand crank 44 so that it is at least partially enclosed by the shutter housing. The hand crank 44 may be disposed on a rear portion of the shutter assembly 10 so that the shutter 30, when attached over a window for example, can be unrolled from inside the window. Alternatively, when the gearbox 42 is not provided, the support member 20 may include a torsion spring. The shutter 30 may be rolled and unrolled with the assistance of the tension in the spring by exerting a force on a bottommost slat 46 by grasping a handle 48 that extends longitudinally along the slat 46 and outwardly from the shutter 30. Other drive mechanism, such as straps and tubular operators are well known to those of ordinary art and are contemplated by the inventor as having use with the present invention.

Figure 5:
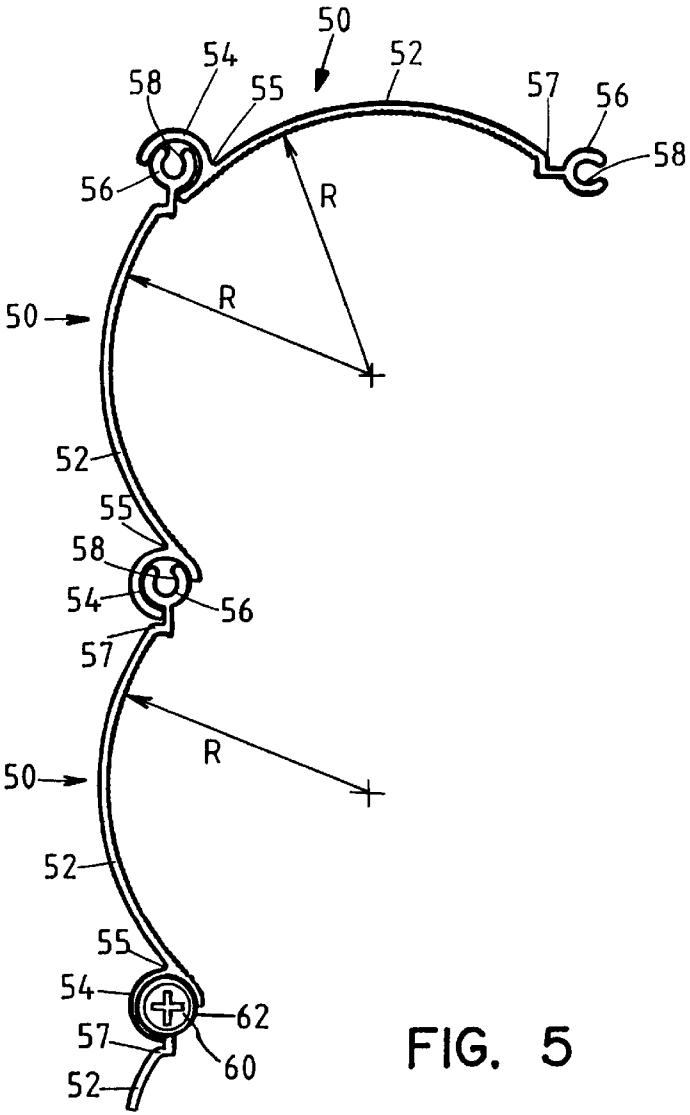
FIG. 5 is a side view of a portion of the shutter curtain of FIG. 4.
Figure 4:
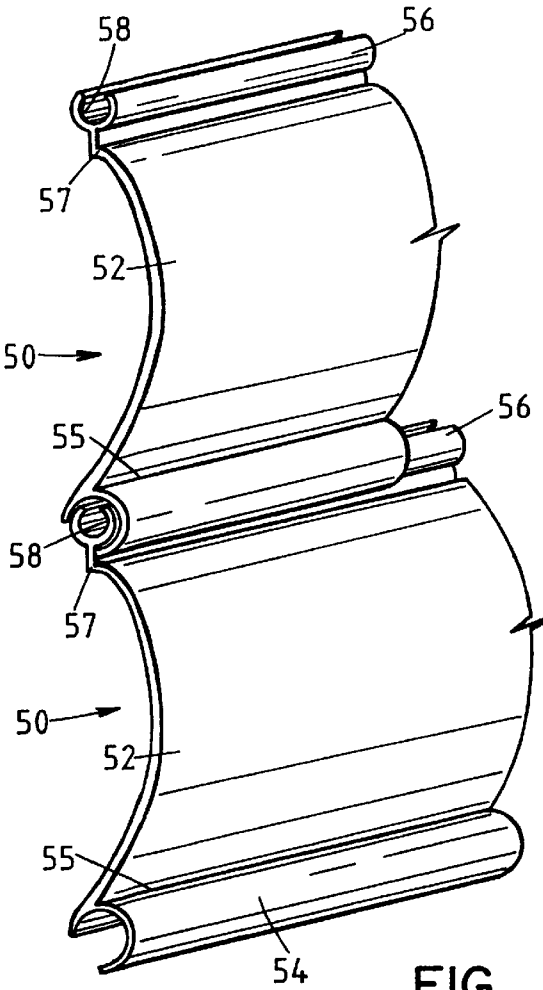
FIG. 4 is a fragmentary perspective view of a shutter curtain formed by single-wall slats according to the present invention.

FIGS. 4 and 5 illustrate a shutter curtain formed by a plurality of shutter slats 50 according to the present invention. Each slat 50 includes an single-wall, arc-shaped slat portion 52. Each slat portion 52 has a substantially constant radius of curvature R (FIG. 5) such that their profile is in the approximate shape of a semi-circle. Each slat 50 further includes an elongated socket 54 integrally formed along longitudinal edge 55 of the slat portion 52. A rod 56 is integrally formed along the other longitudinal edge 57 of the slat portion 52. The rod 56 includes a groove or channel formed therein and running along the longitudinal length of the rod 56 to form an integral screw boss 58. The combined rod 56 and screw boss 58 approximate the shape of a second, smaller socket integrally formed on the edge of the slat portion 52. The slats 50 are typically fabricated from extruded aluminum, but other materials and fabrication methods will be apparent to those of ordinary skill in the art.

The slats are fabricated such that the inner diameter of the socket 54 is slightly larger than the outer diameter of the rod 56. The shutter curtain is assembled by sliding the rod 56 of one slat 50 into the socket 54 of the adjacent slat 50. The slats 50 are oriented with their concave surfaces on the same side of the shutter curtain so that the curtain rolls up properly onto the shutter support member 20.

Referring to FIG. 5, when the slats 50 are assembled, the rods 56 are pivotal within the sockets 54 to facilitate movement of the shutter curtain between the rolled and unrolled positions. Since the sockets 54 cover over half the diameter of the rods 56, the rods 56 are permanently retained within the sockets 54. The sockets 54 and rods 56 are configured to form a hinge that allows the connected slats 50 to rotate between a first position in which the sockets 54 and the rods 56 of the slats 50 are substantially linearly aligned, and a second position wherein the slat portions 52 combine to define an arc having a substantially constant radius of curvature R.

Figure 6:
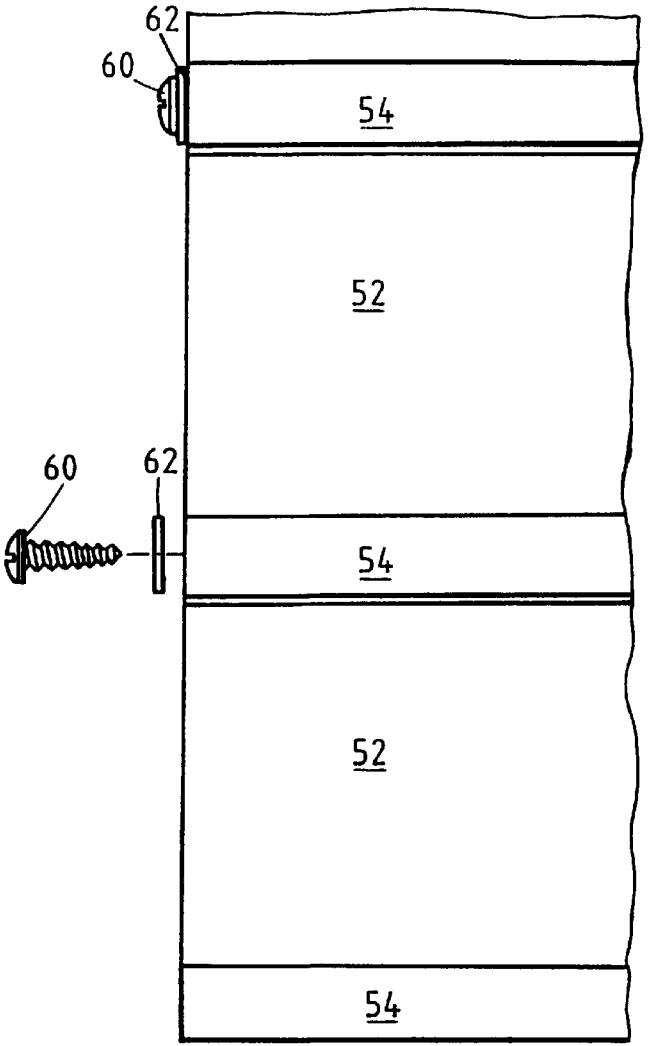
FIG. 6 is a fragmentary front view of the shutter curtain of FIG. 4.

Once the shutter curtain is assembled, the slats 50 are held in vertical alignment by screws 60 that are inserted into the screw bosses 58 as shown in FIG. 5 and FIG. 6, which is a partial front view of a shutter curtain made with a plurality of slats 50 according to the present invention. Each screw 60 may be accompanied by a washer 62. The head of the screw 60 and the washer 62 have outer diameters that are larger than the outer diameter of the rod 56 and smaller than the outer diameter of the socket 54. Configured in this way, the screw 60 and the washer 62 engage both the socket 54 of one slat 50 and the rod 56 of the other slat 50 to prevent relative lateral movement of the slats 50, yet the screw 60 and washer 62 do not extend past the edges of the socket 54.

Figure 7:
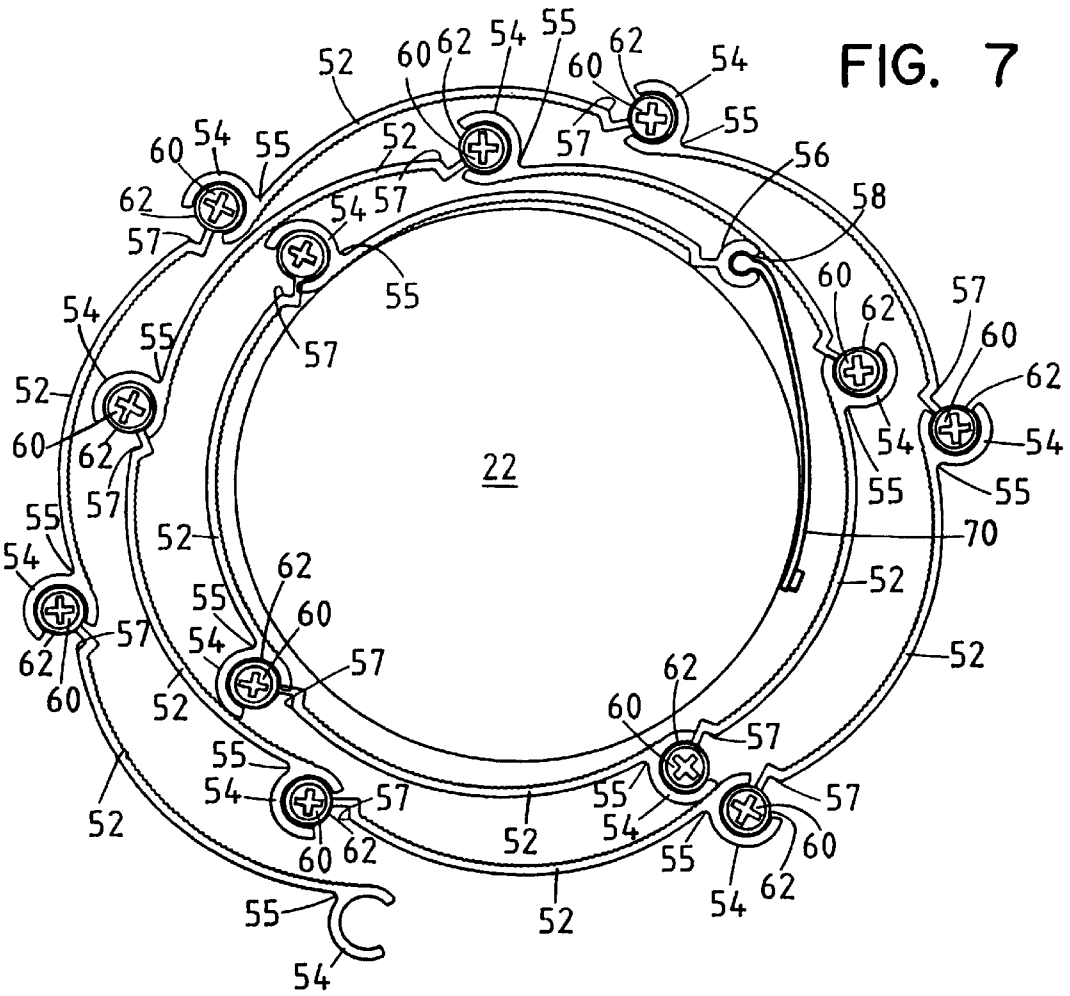
FIG. 7 is a side view of the shutter curtain of FIG. 4 rolled onto a shutter support member.

The structure of the slats 50 according to the present invention in combination with the screws 60 and washers 62 as described allows the shutter curtain to occupy a minimum amount of space when the curtain is rolled up onto the shutter support member 20 as shown in FIG. 7. In this figure, the shutter curtain is attached to the shutter central shaft 22 by a piece of spring steel 70 attached at one end to the shutter central shaft 22 and at the other end to the rod 56 and screw boss 58 of the topmost slat 50. The shutter curtain could, alternatively, be attached to the shutter support member 20 by the socket 54 of the topmost slat 50 if the slats 50 are oriented with the sockets 54 above the rods 56. As shown in the FIG. 5, the shutter curtain is rolled up onto the shutter support member 20 without the screws 60 and washers 62 engaging the other slats 50 as the shutter curtain is rolled up. Because the alignment hardware does not engage the other slats 50, the shutter curtain is rolled up with a minimum roll diameter, thereby requiring a minimum amount of space in the shutter housing for storing the shutter curtain. The roll diameter is further minimized by the curvature of the slat portions 52 and the rotation permitted by the hinges.

Figure 1:
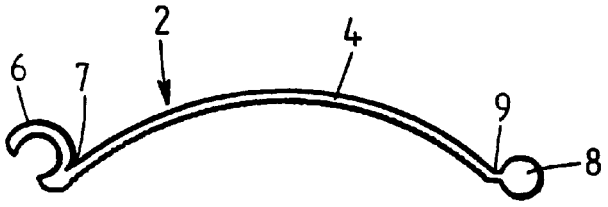
FIG. 1 PRIOR ART
FIG. 1 is a side view of a prior art single-wall shutter slat.
Figure 2:
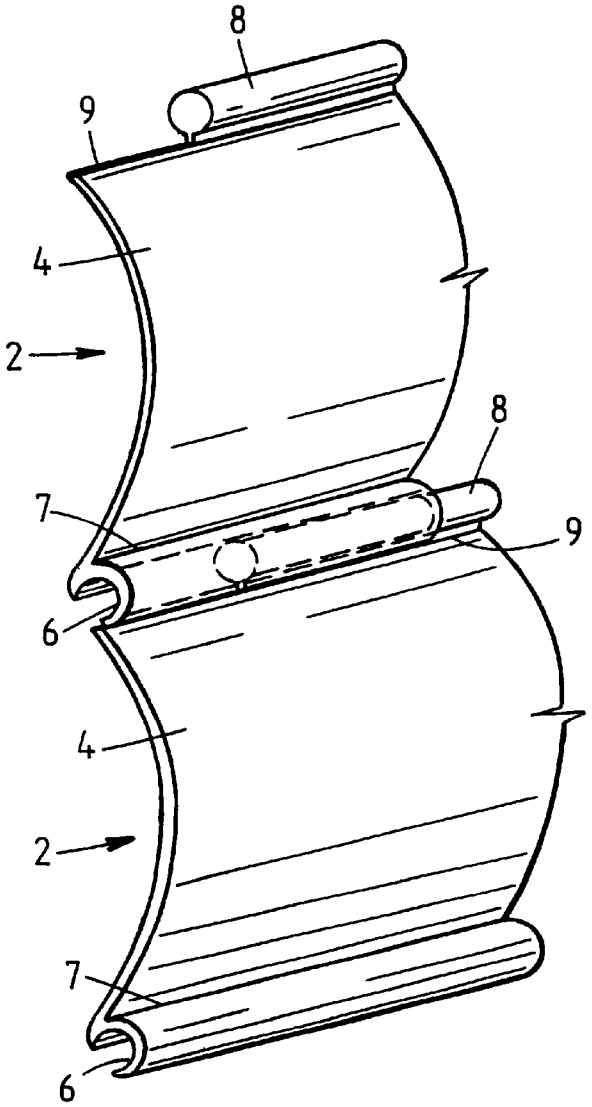
FIG. 2 PRIOR ART
FIG. 2 is a fragmentary perspective view of a shutter curtain formed by a plurality of the slats according to FIG. 1.

The slats 50 with integrated screw bosses 58 according to the present invention offer several advantages over previous single-wall slats. First, as described above, the slats 50 allow the shutter curtain to be rolled up tightly on the shutter support member 20 to minimize the storage space required for the shutter curtain. Additionally, the slats 50 according to the present invention reduce the cost and time required to fabricate and assemble the shutter curtains compared with previous single-wall slat configurations. Because the screw boss 58 is formed within the rod 56, the slats 50 are fabricated using as much or less, but not more, material during the extrusion process. Moreover, the machining steps required to remove the end portions of the rods 8 of the slat 2 in FIGS. 1 and 2 are eliminated, thereby reducing the labor costs and the time required to assemble the shutter curtains.

Figure 8:
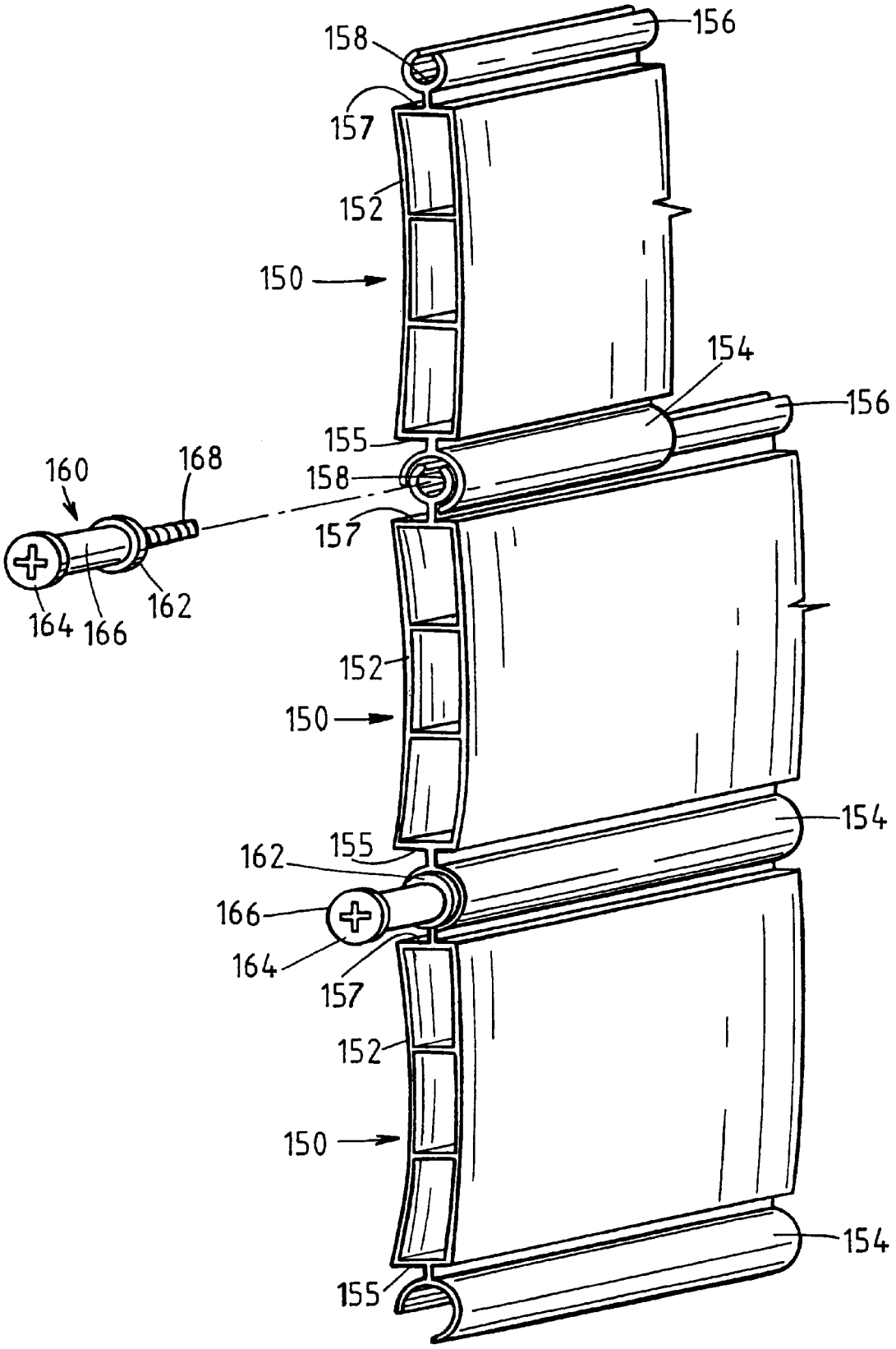
FIG. 8 is a fragmentary perspective view of a shutter curtain formed by double-wall slats according to the present invention and including extension members according to the present invention.

FIG. 8 illustrates a shutter curtain formed by a plurality of shutter slats 150 according to an alternative embodiment of the present invention. Each slat 150 includes an double-wall slat portion 152. Each slat portion 152 is arc-shaped to facilitate rolling the shutter curtain onto the shutter support member 20. Each slat 150 further includes an elongated socket 154 integrally formed along the bottom edge 155 of the slat portion 152. A rod 156 is integrally formed along the top edge 157 of the slat portion 152. The rod 156 includes a groove or channel formed therein and running along the longitudinal length of the rod 156 to form an integral screw boss 158. The combined rod 156 and screw boss 158 approximate the shape of a second, smaller socket integrally formed on the edge 157 of the slat portion 152. The slats 150 are typically fabricated from extruded aluminum or polyvinyl chloride, but other materials and fabrication methods will be apparent to those of ordinary skill in the art.

The slats are fabricated such that the inner diameter of the socket 154 is slightly larger than the outer diameter of the rod 156. The shutter curtain is assembled by sliding the rod 156 of one slat 150 into the socket 154 of the adjacent slat 150. The slats 150 are oriented with their concave surfaces on the same side of the shutter curtain so that the curtain rolls up properly onto the shutter support member 20.

When the slats 150 are assembled, the rods 156 are pivotal within the sockets 154 to facilitate movement of the shutter curtain between the rolled and unrolled positions. Since the sockets 154 cover over half the diameter of the rods 156, the rods 156 are permanently retained within the sockets 154. The sockets 154 and rods 156 are configured to form a hinge that allows the connected slats 150 to rotate between a first position in which the sockets 154 and the rods 156 of the slats 150 are substantially linearly aligned, and a second position wherein the slat portions 152 combine to define an arc.

Once the shutter curtain is assembled, extension members 160 are attached to the screw bosses 158. The extension members 160 are adapted to keep the slats 150 vertically aligned and to captivate the shutter curtain within the side tracks 40 to prevent the shutter curtain from pulling out of the side tracks 40 during either an attempted break in or extreme wind conditions. Each of the extension members 160 has an inner flange 162 and an outer flange 164 separated by a neck 166 having a smaller diameter than the flanges 162, 164. Each extension member 160 further includes a threaded shank 168 that is dimensioned to correspond to the screw boss 158. The extension members 160 are attached to the shutter curtain by screwing the shanks 168 into the screw bosses 158 so that the extension members 160 are attached to both ends of a given screw boss 158.

The inner flanges 162 and the outer flanges 164 of the extension members 160 have an outer diameter that is larger than the outer diameter of the rods 156 and smaller than the outer diameter of the sockets 154. Configured in this way, the inner flanges 162 of the extension members 160 attached to either end of a given screw boss 158 engage both the socket 154 of one slat 150 and the rod 156 of the other slat 150 to prevent relative lateral movement of the slats 150. However, because the flanges 162, 164 do not extend past the edges of the socket 154, the extension members 160 do not effect how tightly the shutter curtain may be rolled so that the storage space required for the rolled up shutter remains constant.

Figure 9:
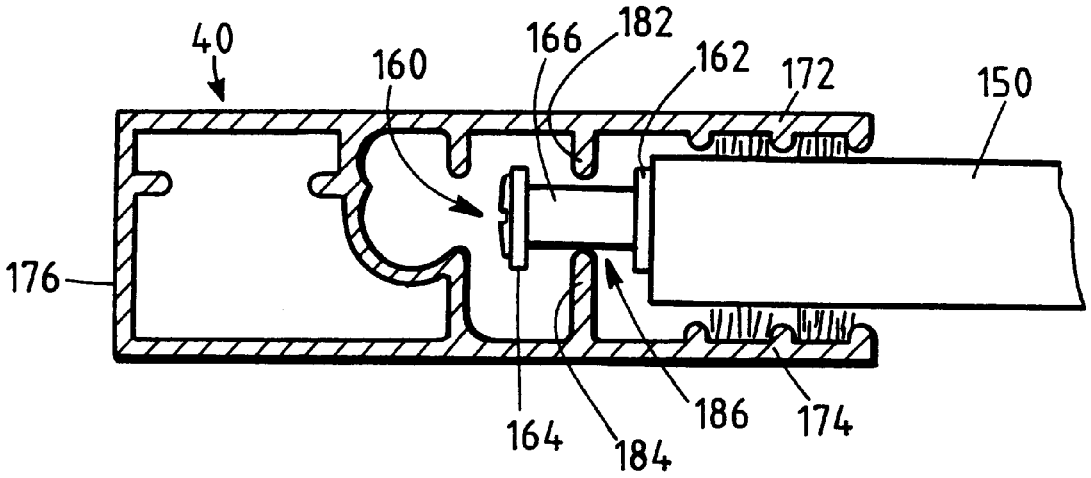
FIG. 9 is a cross-sectional top view of the shutter curtain of FIG. 8 disposed within a side track.

The extension members 160 extend outwardly from the shutter curtain and the outer flanges 164 are captivated by the side tracks 40, as shown in FIG. 9, and prevent the shutter curtain from being pulled out of the shutter tracks 40. Each side track 40 has a pair of side walls 172, 174, and an end wall 176. The side track 40 further includes a pair of fins 182, 184 that extend inwardly from the side walls 172, 174, respectively, and define a gap 186 wide enough to receive the neck 166 of the extension member 160. The neck 166 of the extension member 160 extends through the gap 186 so that the outer flange 164 is disposed on the opposite side of the fins 182, 184 from the inner flange 162 and slat 150.

The diameter of the outer flange 164 is larger than the gap 186 between the fins 182, 184 so that the outer flange 164 cannot be pulled through the gap 186. When the shutter curtain is subjected to a force perpendicular to its surface, the slats 150 bow and the ends of the slats 150 move toward the opening in the side tracks 40. As the slats 150 bow, the outer flanges 164 of the extension members 160 are engaged by the fins 182, 184 of the side track 40 to retain the ends of the slats 150 within the side track 40.

Although the extension members 160 are illustrated in FIG. 8 as a single integral component, the extension members 160 may be formed from multiple components. For example, in one alternative embodiment, a screw is used for the outer flange 164 and the shank 168, and the inner flange 162 and neck 166 are integrally formed as a sleeve that slides onto the shank 168. In another alternative embodiment, the inner flange 162 is a washer and the neck 166 is a separate sleeve and both components slide onto the shank to form the extension member 160.

The screw boss 158 and extension member 160 according to the present invention offer significant benefits over previously known rolling shutters. First, the screw boss 158 and extension member 160 are adaptable to virtually any slat configuration, include single- and double-wall slats and slats with different contours. Second, the combination provides a simple system for accomplishing both slat alignment and slat retention over previously known shutter system. First, the simple, round shape of the extension member 160 is simpler and easier to fabricate than previous components such as the end retainer disclosed in the Barnardo patent that is shaped to match the contour of the slat. Moreover, the extension member 160 attaches by simply screwing the shank 168 into the screw boss 158, and does not require additional attachment hardware, such as rivets.

Other modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A rolling shutter assembly, comprising:

a shutter support member;

a shutter coupled to said shutter support member, said shutter comprising a plurality of individual slats and a plurality of hinges interconnecting said slats;

a first extension member coupled to one of said hinges and being adapted to engage said slats interconnected by said one of said hinges to prevent substantial relative horizontal movement of said interconnected slats; and a pair of shutter tracks, said shutter and said shutter support member being adapted to roll said shutter from an unrolled position in which said slats are disposed in said shutter tracks to a rolled position in which said shutter is rolled up on said shutter support member, wherein said first extension member is disposed within one of said shutter tracks when said shutter is in said unrolled position, said one of said shutter tracks being adapted to engage said first extension member to retain said first extension member and said shutter in said one of said shutter tracks when said shutter is in said unrolled position.

2. An assembly as defined in claim 1, wherein each of said slats comprises:

a slat portion;

a first socket integrally formed along a first longitudinal edge of said slat portion; and a second socket integrally formed along a second longitudinal edge of said slat portion;

wherein said hinges are formed by inserting said second socket of one slat into said first socket of an adjoining slat.

3. An assembly as defined in claim 2, wherein said first extension member comprises a threaded shank and said first extension member is coupled to said one of said hinges by screwing said shank into said second socket.

4. An assembly as defined in claim 1, wherein said first extension member comprises a first flange being adapted to engage said interconnected slats to prevent substantial relative horizontal movement of said interconnected slats, and a second flange engaged by said one of said shutter tracks to retain said first extension member and said shutter in said one of said shutter tracks when said shutter is in said unrolled position.

5. An assembly as defined in claim 4, wherein said one of said shutter tracks has a first fin and a second fin separated by a gap width and said second flange has a flange diameter greater than said gap width, and wherein said first extension member further comprises a neck separating said first and said second flanges and having a neck diameter less than said flange diameter and less than said gap width, said neck being disposed between said first and said second fins when said shutter is in said unrolled position whereby said first and said second fins engage said second flange retain said first extension member and said shutter in said one of said shutter tracks when said shutter is in said unrolled position.

6. An assembly as defined in claim 4, wherein said hinge has a hinge diameter and said first and said second flanges have a flange diameter less than said hinge diameter.

7. An assembly as defined in claim 1, further comprising a second extension member coupled to said one of said hinges opposite said first extension member and being adapted to engage said slats interconnected by said one of said hinges to prevent substantial relative horizontal movement of said interconnected slats, wherein said second engagement member is disposed within the other of said shutter tracks when said shutter is in said unrolled position, said other of said shutter tracks being adapted to engage said second extension member to retain said second extension member and said shutter in said other of said shutter tracks when said shutter is in said unrolled position.

8. A rolling shutter assembly, comprising:

a shutter support member;

a shutter coupled to said shutter support member, said shutter comprising a plurality of individual slats and a plurality of hinges interconnecting said slats;

a pair of extension members associated with each of said plurality of hinges and coupled to opposite ends of said associated hinge, said pair of extension members being adapted to engage said slats interconnected by said associated hinge to prevent substantial relative horizontal movement of said interconnected slats; and a pair of shutter tracks, said shutter and said shutter support member being adapted to roll said shutter from an unrolled position in which said slats are disposed in said shutter tracks to a rolled position in which said shutter is rolled up on said shutter support member, wherein said extension members are disposed within said shutter tracks when said shutter is in said unrolled position, said shutter tracks being adapted to engage said extension members to retain said extension members and said shutter in said shutter tracks when said shutter is in said unrolled position.

9. An assembly as defined in claim 8, wherein each of said slats comprises:

a slat portion;

a first socket integrally formed along a first longitudinal edge of said slat portion; and a second socket integrally formed along a second longitudinal edge of said slat portion;

wherein said hinges are formed by inserting said second socket of one slat into said first socket of an adjoining slat.

10. An assembly as defined in claim 9, wherein each of said extension members comprises a threaded shank and said extension member is coupled to said associated hinge by screwing said shank into said second socket.

11. An assembly as defined in claim 8, wherein each of said extension members comprises a first flange being adapted to engage said interconnected slats to prevent substantial relative horizontal movement of said interconnected slats, and a second flange engaged one of said shutter tracks to retain said extension member and said shutter in said one of said shutter tracks when said shutter is in said unrolled position.

12. An assembly as defined in claim 11, wherein said one of said shutter tracks has a first fin and a second fin separated by a gap width and said second flange has a flange diameter greater than said gap width, and wherein said extension member further comprises a neck separating said first and said second flanges and having a neck diameter less than said flange diameter and less than said gap width, said neck being disposed between said first and said second fins when said shutter is in said unrolled position whereby said first and said second fins engage said second flange retain said extension member and said shutter in said one of said shutter tracks when said shutter is in said unrolled position.

13. An assembly as defined in claim 11, wherein said hinge has a hinge diameter and said first and said second flanges have a flange diameter less than said hinge diameter.

* * * * *